US005332265A

United States Patent [19]

Groess et al.

[11] Patent Number: 5,332,265

[45] Date of Patent: Jul. 26, 1994

[54] ADVERTISING ASSEMBLY

[75] Inventors: Michael S. Groess, Oakdale; Douglas P. Bodziak, Lake Elmo, both of Minn.

[73] Assignee: Minnesota Mining and Manufacturing Company, St. Paul, Minn.

[21] Appl. No.: 8,612

[22] Filed: Jan. 22, 1993

[51] Int. Cl.[5] ..... G09F 3/00

[52] U.S. Cl. ..... 283/56; 283/81; 283/101

[58] Field of Search ..... 283/51, 56, 81, 101, 283/105; 428/40–43

[56] References Cited

U.S. PATENT DOCUMENTS

| | | | |
|---|---|---|---|
| D. 306,314 | 2/1990 | Jessamine et al. | D19/1 |
| 4,637,635 | 1/1987 | Levine | 283/81 |
| 4,680,210 | 7/1987 | Corcoran | 428/42 |
| 4,763,930 | 8/1988 | Matney | 283/81 |
| 4,842,303 | 6/1989 | Molenda | 281/38 |
| 4,876,131 | 10/1989 | Ashby et al. | 428/42 |
| 4,907,825 | 3/1990 | Miles et al. | 281/51 |
| 4,927,179 | 5/1990 | Ehret et al. | 283/81 X |
| 4,978,146 | 12/1990 | Wauthen et al. | 283/81 |
| 5,101,756 | 4/1992 | Strumbos | 116/234 |
| 5,129,682 | 7/1992 | Ashby | 283/81 |
| 5,135,261 | 8/1992 | Cusack et al. | 285/81 |
| 5,139,286 | 8/1992 | Gold | 283/56 |

*Primary Examiner*—Mark Rosenbaum
*Assistant Examiner*—Willmon Fridie, Jr.
*Attorney, Agent, or Firm*—Gary L. Griswold; Walter N. Kirn; William L. Huebsch

[57] ABSTRACT

An advertising assembly which comprises a paper or polymeric backing layer having opposite major surfaces printed with advertising indicia; and a plurality of sheets each comprising a layer of flexible polymeric material having a coating of repositionable pressure sensitive adhesive on one of its side surfaces on a second end portion adjacent a second end while being free of adhesive on both of its side surfaces along a first end portion. The sheets are releasably adhered in parallel rows to the first surface of the backing layer by the coatings of pressure sensitive adhesive with the sheets in each row being positioned with their side edge surfaces adjacent and with their first end portions aligned, and can be printed with advertising indicia.

14 Claims, 4 Drawing Sheets

ADVERTISING ASSEMBLY

TECHNICAL FIELD

The present invention relates to advertising assemblies including removable portions that are intended to be either given to persons or attached in documents (e.g., magazines, books, etc.) to bring attention to products of the advertiser.

BACKGROUND ART

Advertising assemblies are known that include removable portions and are intended to be either given to persons that may be potential customers or attached in documents (e.g., magazines, books, etc.) to bring that persons or a document readers attention to products or services of the advertiser and allow that person to remove the removable portion which may, for example, may be a return card with which that person may send for further information or order the advertisers products, or may be a coupon that can be applied as part of the purchase price of the advertisers products. Such an advertising insert or assembly is described and claimed in U.S. Pat. No. 4,842,303 which also includes an extensive "Description of Prior Art" related thereto from column 1, line 15 through column 2, line 19. Such known advertising assemblies, however, have been limited in their versatility for use in certain types of advertising endeavors.

DISCLOSURE OF INVENTION

The present invention provides a novel advertising assembly that include removable portions and can be either given to persons that may be potential customers (e.g., used as handouts at trade show or business meetings) or attached in documents (e.g., inserted or tipped into books, catalogs, brochures, magazines or directories) to bring that persons attention or a document readers attention to products or services of the advertiser, and allows that person to remove the removable portions which may, for example, be useful for marking portions of documents (e.g., the document in which the assembly is attached or another document) or other surfaces, and may carry one or more messages that aid in the advertising endeavor.

According to the present invention there is provided an advertising assembly which comprises a backing layer having opposite major surfaces, one or both of which is free of release coatings and is printable, either or both of which major surfaces is printed in register with advertising indicia; and a plurality of sheets which may be generally of the type called tape flags that are described in U.S. Pat. No. 4,907,825, each of which sheets comprises a layer of flexible polymeric material, has a coating of repositionable pressure sensitive adhesive on one of its side surfaces on a second end portion adjacent a second end while being free of adhesive on both of its side surfaces along a first end portion. The sheets are releasably adhered in parallel rows to the first surface of the backing layer by the coatings of pressure sensitive adhesive with the sheets in each row being positioned with their side edge surfaces adjacent and with their first end portions aligned.

As an example, the sheets or tape flags can be adhered in four parallel rows on the backing layer with the first end portions of the sheets in each of two pairs of the four rows adjacent.

The first end portions of the sheets or tape flags on the advertising assembly can be printed with brightly colored ink in one or more colors to make them visually distinctive, and the sheets can be printed with information (e.g., advertising indicia) over the brightly colored ink on their first end portions, over their second end portions, or both. Their second end portions, when free of printing, can be generally transparent when adhered to a substrate, and the sheets can have a surface opposite the coatings of pressure sensitive adhesive that are adapted to be written on.

Also, the major surfaces of the sheets or tape flags can be rectangular, or can have different shapes corresponding to the outline of one or more known animals or objects such as rabbits, arrows, medicine capsules or footballs as may be appropriate to the advertising endeavor.

Additionally, the advertising assembly can further include a plurality of the tape flags or sheets releasably adhered to the surfaces opposite the backing layer of the tape flags or sheets adhered to the backing layer, thereby providing two layers of removable tape flags or sheets that may or may not be of the same shape, or color, may or may not have the same peripheral shape, and may or may not have the same indicia printed thereon.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
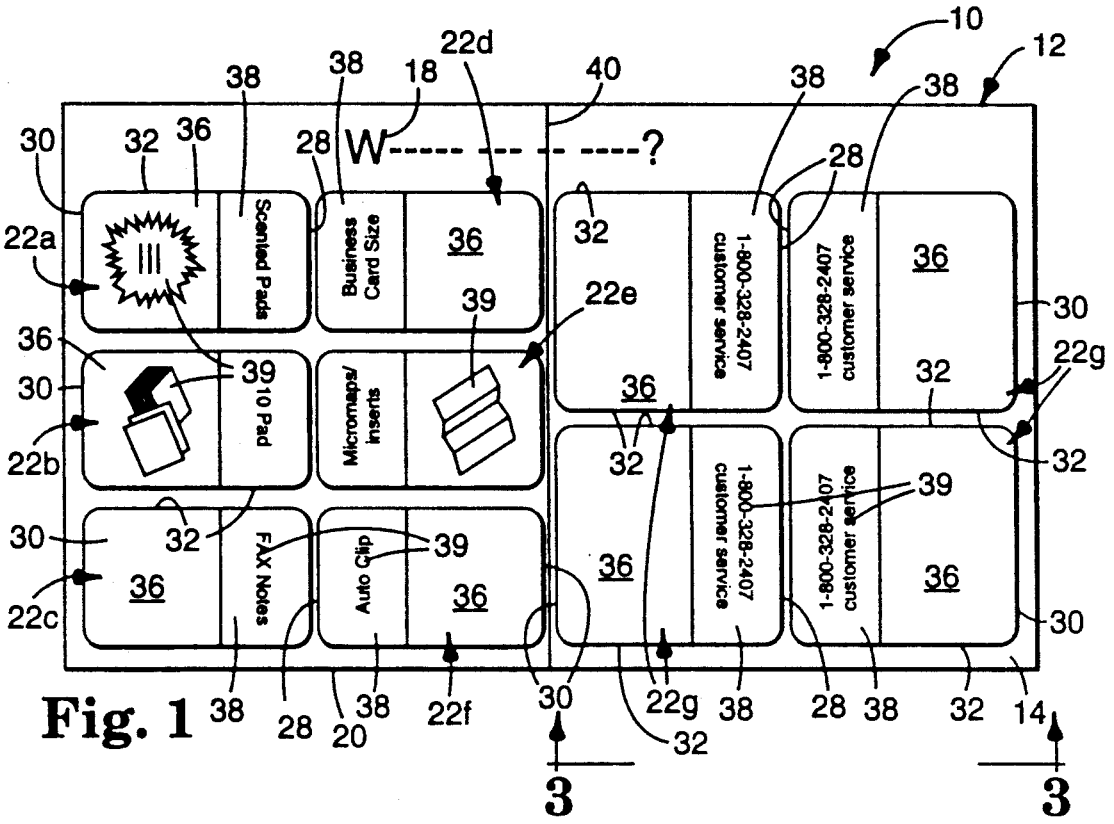
FIG. 1 is a plan view of a first side of a first embodiment of an advertising assembly according to the present invention.
Figure 2:
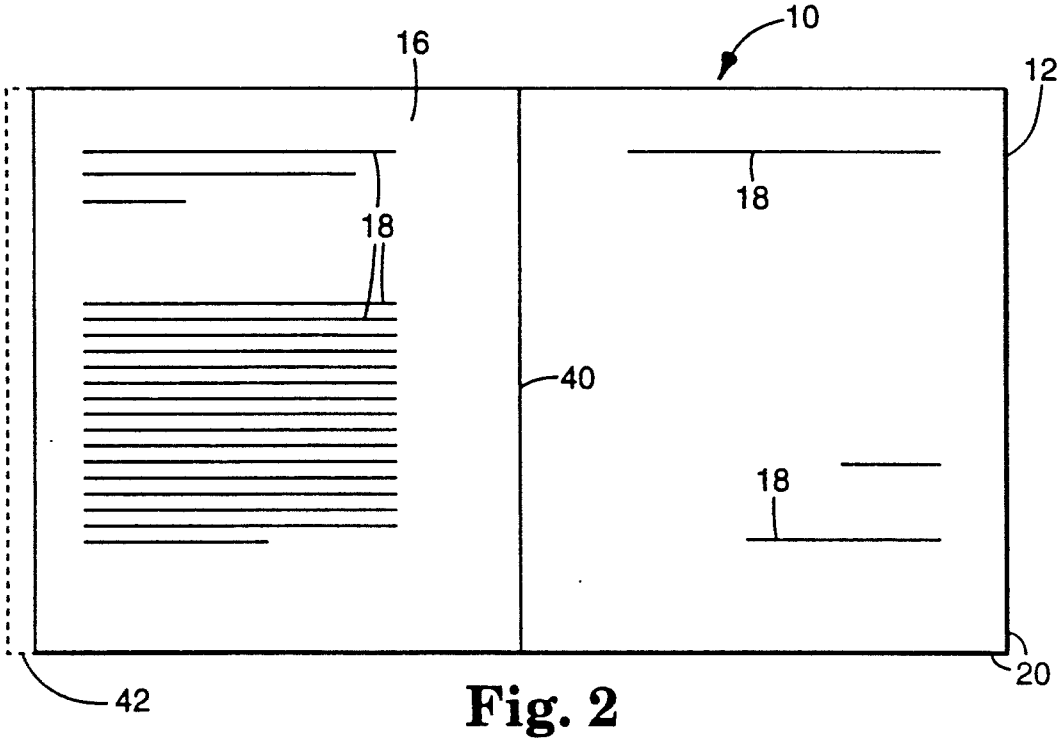
FIG. 2 is a plan view of an opposite second side of the advertising assembly of FIG. 1.
Figure 3:
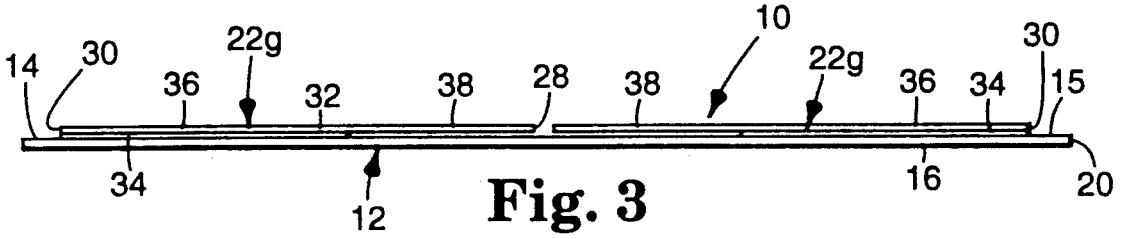
FIG. 3 is an enlarged fragmentary edge view taken approximately along lines 3—3 of FIG. 1.

Referring now to FIGS. 1 through 3 of the drawing, there is shown a first embodiment of an advertising assembly according to the present invention generally designated by the reference numeral 10.

Generally the advertising assembly 10 comprises a paper backing layer 12 (e.g., of twelve or seven point card stock or bond paper) having opposite first and second major printable surfaces 14 and 16, which major surfaces are free of release coatings such as silicone, but may have coatings to enhance printing thereon such as conventional clay coatings. Advertising indicia 18 is printed in register on both major surfaces 14 and 16 (i.e., by "printed in register" we mean printed in a precise location with respect to the peripheral edges 20 of the backing layer, rather than being printed in a random pattern on the sheet stock from which the backing layer was cut). The advertising assembly 10 also comprises a plurality of smaller width die cut sheets 22*a*, 22*b*, 22*c*, 22*d*, 22*e*, and 22*f* and four larger width die cut sheets 22*g*. the sheets 22*a*, 22*b*, 22*c*, 22*d*, 22*e*, 22*f* and 22*g* are generally of the type called tape flags that are described and claimed in U.S. Pat. No. 4,907,825 issued Mar. 13, 1990, the content whereof is incorporated herein by reference. Generally, each of the sheets or tape flags 22*a*, 22*b*, 22*c*, 22*d*, 22*e*, 22*f* and 22*g* comprises a layer of flexible polymeric material (e.g., of cellulose acetate or polyester) having opposite major side surfaces, first and second opposite ends 28 and 30, opposite edge surfaces 32 between its major side surfaces and between its first and second opposite ends 28 and 30, and has a coating 34 of repositionable pressure sensitive adhesive (see FIG. 3) on one side surface along a second end portion 36 adjacent its second end 30 while being free of adhesive on both of its side surfaces along a first end portion 38 thereof adjacent its first end 28. The first end portions 38 of the tape flags 22*a*, 22*b*, 22*c*, 22*d*, 22*e*, 22*f* and 22*g* are visually distinctive, and their adhesive coated second end portions 36, when free of printing, are generally transparent when adhered to a substrate. The tape flags 22*a*, 22*b*, 22*c*, 22*d*, 22*e*, 22*f* and 22*g* are releasably adhered in parallel rows to the first surface 14 of the backing layer 12 by the coatings 34 of pressure sensitive adhesive with the tape flags 22*a*, 22*b*, 22*c*, 22*d*, 22*e*, 22*f* and 22*g* in each row being positioned with their edge surfaces 32 adjacent and with their first end portions 38 aligned.

As illustrated, the first end portions 38 of the tape flags 22*a*, 22*b*, 22*c*, 22*d*, 22*e*, 22*f* and 22*g* are smaller in area than their second end portions 36, and are brightly colored by being printed with brightly printed ink to provide their visual distinction. The tape flags 22*a*, 22*b*, 22*c*, 22*d*, 22*e*, 22*f* and 22*g* are adhered in four parallel rows on the backing layer 12 with the first end portions 38 of the tape flags 22*a*, 22*b*, 22*c*, 22*d*, 22*e*, 22*f* and 22*g* in each of two pairs of the four rows being adjacent (i.e., the first end portions 38 of the four wide tape flags 22*g* in one pair of rows adjacent and the first end portions of the narrower tape flags 22*a*, 22*b*, 22*c*, 22*d*, 22*e*, and 22*f* in the other pair of rows adjacent). The first and second end portions 38 and 36 of the tape flags 22*a*, 22*b*, 22*c*, 22*d*, 22*e*, 22*f* and 22*g* are formed by a single layer of polymeric material, and the tape flags 22*a*, 22*b*, 22*c*, 22*d*, 22*e*, 22*f* and 22*g* are printed with indicia 39 over the brightly colored ink on their first end portions 28 and, on the tape flags 22*a*, 22*b*, and 22*e*, on their second end portions 36.

The backing layer 12 can be folded in half along a fold line 40 formed by creasing the backing layer 12 to bring two portions of the first surface 14 together with the tape flags 22*a*, 22*b*, 22*c*, 22*d*, 22*e*, 22*f* and 22*g* therebetween, which is useful when the advertising assembly is used as a handout. Alternatively, the backing layer 12 can be used flat and have means for attaching it into a document such as a book, catalog, brochure, magazine or directory between the pages of that document, such as one or more stripes of adhesive on the second surface 16 of the backing layer 12 (not shown) or a portion of the backing layer 12 that extends along one side thereof, such as the portion 42 indicated by a dotted outline. The backing layer 12 may optionally be perforated between such an extending portion 42 and its main portion, which may be useful if the advertising assembly is intended to be removed from the document. Also, the backing layer may be of a size and material suitable to be mailed and be have indicia printed on one of its surfaces that makes it useable for a return card after the tape flags 22*a*, 22*b*, 22*c*, 22*d*, 22*e*, 22*f* and 22*g* are removed.

Figure 4:
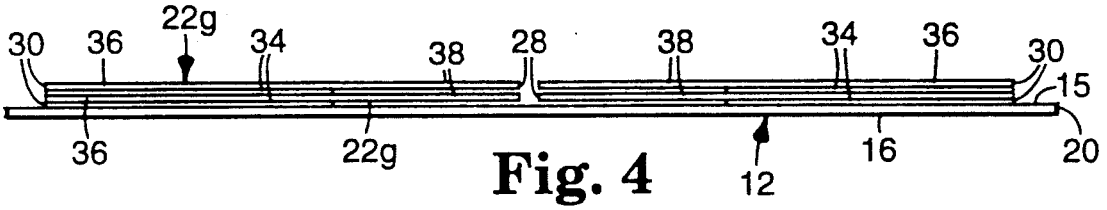
FIG. 4 is an enlarged fragmentary edge view taken approximately along lines 3—3 of FIG. 1 that illustrates a possible modification of the advertising assembly illustrated in FIGS. 1 through 3.

As is illustrated in FIG. 4, the advertising assembly 10 could be modified to further include a plurality of sheets or tape flags 22*g* releasably adhered to the surfaces opposite the backing layer of the sheets or tape flags 22*g* adhered to the backing layer 12. Thus two layers of sheets or tape flags are provided, and three, four or more layers could be provided if desired.

Figure 5:
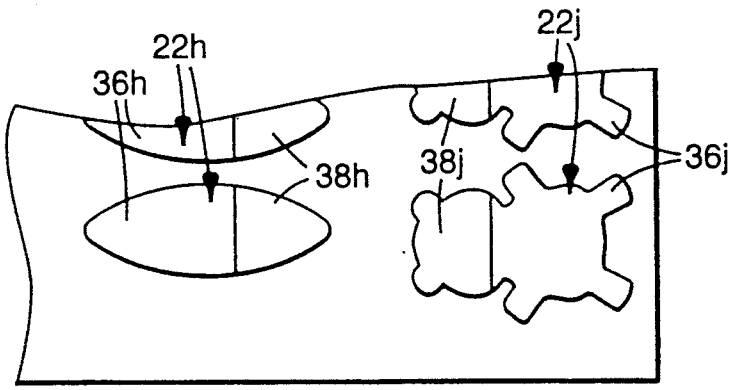
FIG. 5 is a fragmentary plan view that illustrates a possible modification of the advertising assembly illustrated in FIGS. 1 through 3.

Also, as is indicated in FIG. 5, the advertising assembly 10 could be modified so that the major surfaces of sheets 22*h* and 22*j* included therein have shapes corresponding to the outlines of objects or animals. The first end portions 38*h* and 38*j* may or may not be visually distinctive with respect to their second end portions 36*h* and 36*j*, and either or both of the end portions 36*h*, 36*j*, 38*h* and 38*j* could have advertising or other indica (not shown) printed thereon.

A multiplicity of the advertising assemblies 10 can be made by a method similar to that used to make labels by (1) providing a length of paper material for use as backing layers 12 which has major printable surfaces; (2) providing a length of flexible polymeric material for use in making the tape flags 22*a*, 22*b*, 22*c*, 22*d*, 22*e*, 22*f* and 22*g* that has three longitudinally extending stripes of repositionable pressure sensitive adhesive in the areas from which the second end portions 36 of the tape flags will be formed spaced by two parallel longitudinally extending stripes of brightly colored ink in the areas from which the first end portions 38 of the tape flags 22*a*, 22*b*, 22*c*, 22*d*, 22*e*, 22*f* and 22*g* will be formed; (3) feeding the length of polymeric material and the length of paper material simultaneously into a printing and converting device (e.g., a flexographic printing press) which prints indicia in register on one or both surfaces of the length of paper material and on the non adhesive coated surface of the length of polymeric material; (4) laminating the adhesive stripes on the length of polymeric material to the length of paper material with a desired registration between the printed indicia on the two materials; (5) passing the laminated polymeric and paper materials through a controlled depth die cutting device which cuts the tape flags 22*a*, 22*b*, 22*c*, 22*d*, 22*e*, 22*f* and 22*g* from the length of polymeric material; and (5) removing the portion of the length of polymeric material around the tape flags 22*a*, 22*b*, 22*c*, 22*d*, 22*e*, 22*f* and 22*g*. The advertising assemblies 10 can then be cut apart, or can be rolled into a roll from which they can be unrolled and cut apart at another location. Alternatively, the length of paper material can be perforated between the advertising assemblies 10 and the advertising assemblies can later be separated by tearing them apart along the perforations after they have first either been rolled into a roll or fan folded into a stack.

Figure 6:
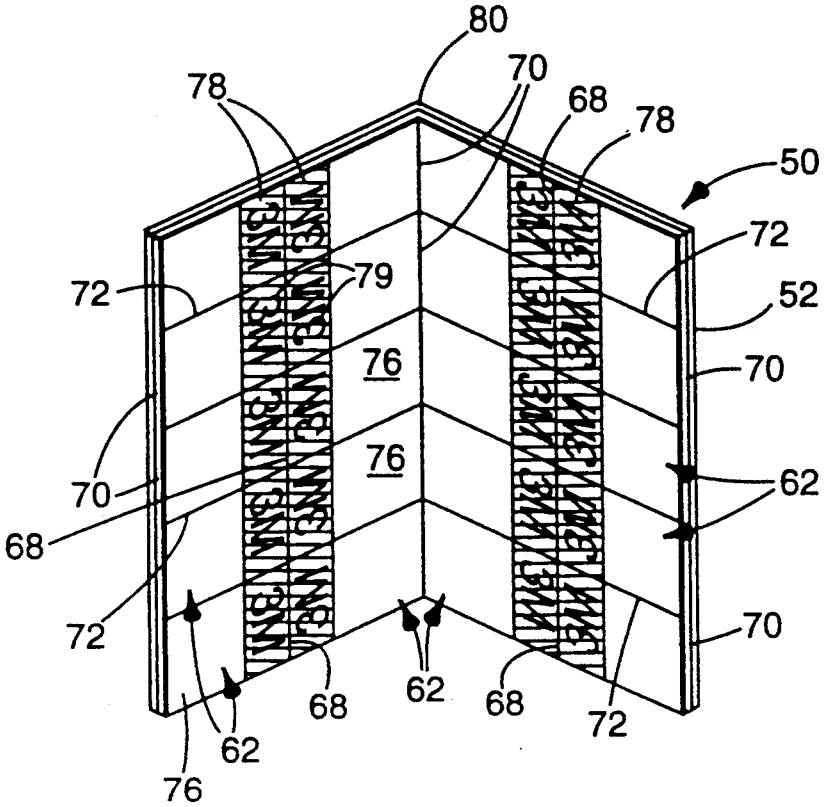
FIG. 6 is a perspective view of a second embodiment of an advertising assembly according to the present invention.

FIG. 6 illustrates a second alternative embodiment of an advertising assembly 50 according to the present invention that comprises a paper backing layer 52 having opposite first and second major printable surfaces that are free of release coatings such as silicone; advertising indicia (not shown) printed in register on one or both of its major surfaces; and a plurality of tape flags 62 similar in structure to the tape flags 22*a*, 22*b*, 22*c*, 22*d*, 22*e*, 22*f* and 22*g* described above in that they each comprise a layer of flexible polymeric material having opposite major side surfaces, first and second opposite ends 68 and 70, opposite edge surfaces 72 between their major side surfaces and between their first and second opposite ends 68 and 70, and they each have a coating of repositionable pressure sensitive adhesive on their side surfaces along a second end portion 76 adjacent their second ends 70 while being free of adhesive on both of their side surfaces along a first end portion 78 thereof adjacent their first ends 68. The first end portions 78 of the tape flags 62 are visually distinctive, and their adhesive coated second end portions 76, when free of printing, are generally transparent when adhered to a substrate. The tape flags 62 are releasably adhered in parallel rows to the first surface of the backing layer 52 by the coatings of pressure sensitive adhesive on their second end portions 76 with the tape flags 62 in each row being positioned with their edge surfaces 72 closely adjacent and with their first end portions 78 aligned. The first end portions 78 of the tape flags 62 are smaller in area than their second end portions 76, and are brightly colored by being printed with brightly printed ink to provide their visual distinction. The tape flags 62 are adhered in four parallel rows on the backing layer 52 with the first end portions 78 of the tape flags 62 in each of two pairs of the four rows being adjacent. The first and second end portions 78 and 76 of the tape flags 62 are formed by only a single layer of polymeric material, and the tape flags 62 are printed with indicia 79 over the brightly colored ink on their first end portions 78.

The backing layer 52 can be folded in half along a fold line 80 embossed in it to bring two portions of its surface on which the tape flags 62 are adhered together, which is useful when the advertising assembly 50 is used as a handout. Alternatively, the backing layer 52 can be used flat and have means of the type described above for the backing layer 12 for attaching it into a document between the pages of that document.

Figure 7:
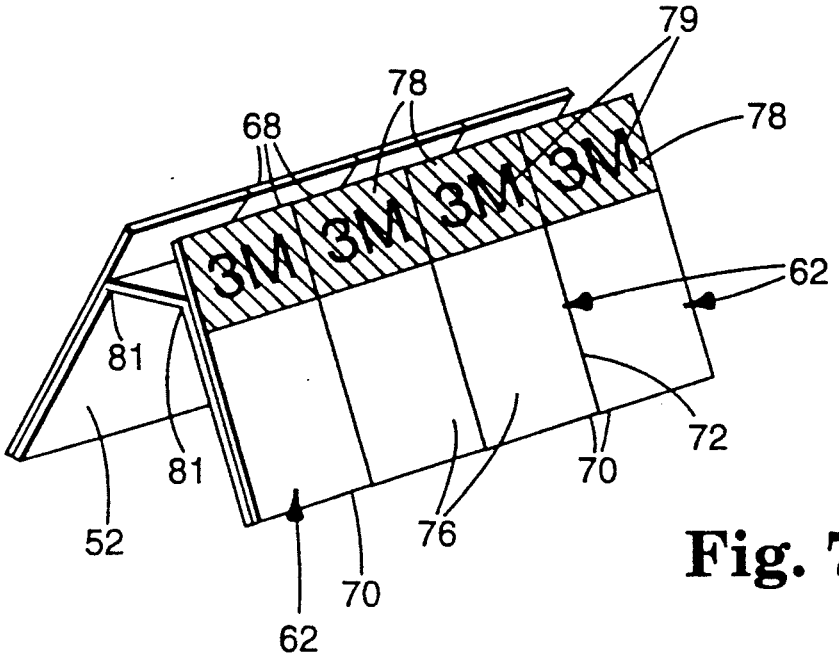
FIG. 7 is a perspective view of a portion of the advertising assembly of FIG. 6 bent to present sheets thereon for easy removal.

Optionally, as is shown in FIG. 7 which shows only half of the advertising assembly 50 separated along the fold line 80, the backing can be scored to form additional spaced fold lines 81 extending parallel to the rows of tape flags 62 and positioned generally along the juncture between the first and second end portions 78 and 76 of the tape flags 62, and can be bent along those fold lines to separate the first end portions 78 of the tape flags 62 in those rows from the backing layer 52 as is illustrated in FIG. 7 and place them in a position in which they can be easily grasped to remove them from the backing layer 52.

Figure 8:
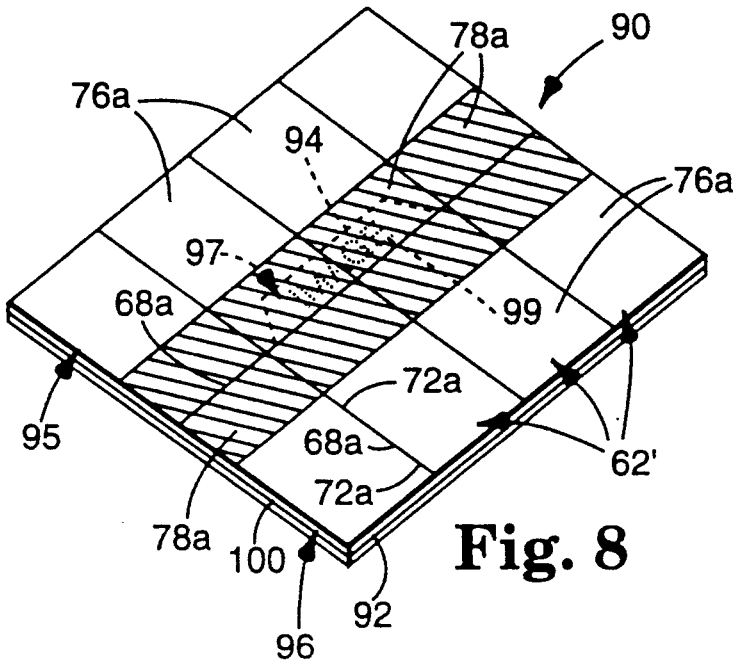
FIG. 8 is a perspective view of a third embodiment of an advertising assembly according to the present invention.
Figure 9:
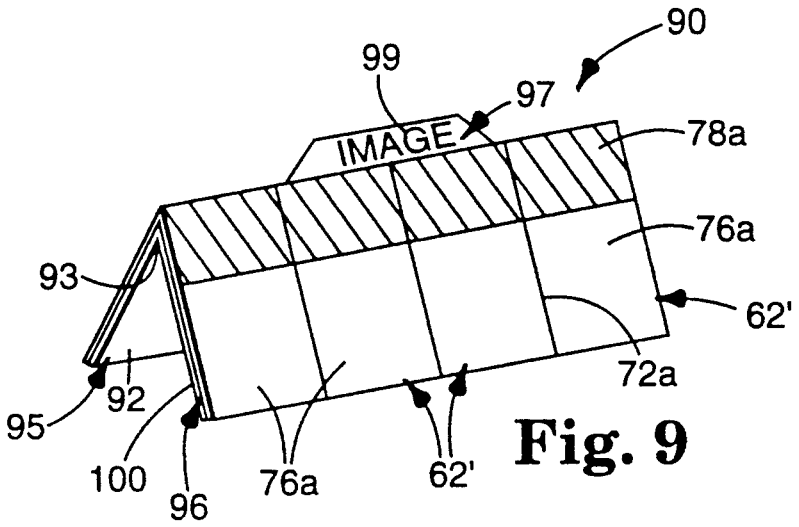
FIG. 9 is a perspective view of the advertising assembly of FIG. 8 bent to present sheets thereon for easy removal and display an indicia bearing tab-like part thereof.

FIGS. 8 and 9 illustrate a third alternative embodiment of an advertising assembly 90 according to the present invention that comprises a paper backing layer 92 having opposite first and second major printable surfaces that are free of release coatings such as silicone; advertising indicia printed in register on one or both of its major surfaces; and a plurality of tape flags 62' having essentially the same structure as the tape flags 62 described above, on which tape flags 62' the same parts have been given the same reference numerals to which has been added the suffix "a". The tape flags 62' are releasably adhered in parallel rows to the first surface of the backing layer 92 by the coatings of pressure sensitive adhesive on their second end portions 76*a* with the tape flags 62' in each row being positioned with their edge surfaces 72*a* closely adjacent and with their first end portions 78*a* aligned. The first end portions 78*a* of the tape flags 62' are adhered in two parallel rows on the backing layer 92 with the first end portions 78*a* of the tape flags 62' in the two rows adjacent. The backing layer 92 has aligned spaced fold line portions 93 parallel to the rows of tape flags 62' and aligned with the adjacent first ends 68*a* of the tape flags 62', and a cut 94 through the backing layer 92 between the adjacent ends of the fold line portions 93 that extends under the first end portions 78*a* of some of the tape flags 62*a* in one of the rows. The spaced fold line portions 93 and the cut 94 divide the backing layer 92 into first and second portions 95 and 96 with the first portion 95 of the backing layer 92 including a major part 100 on one side of the fold line portions 93 and a tab-like part 97 on the other side of the aligned fold line portions 93 and extending under the first end portions 78*a* of some of the tape flags 62*a* that are adhered to the second portion 96 of the backing layer 92. When, as is illustrated in FIG. 9, the backing layer 92 is bent along the aligned fold line portions 93 to move toward each other the portions of its surface opposite the tape flags 62', the tab-like part 97 will deflect and move past the first end portions 78*a* of the tape flags 62*a* over it to a position where the tab-like part 97 will project between the adjacent first ends 68*a* of the tape flags 62' in the two rows so that the tab-like part 97 and graphics 99 printed on it will be easily seen by a user of the advertising assembly 90, thereby bringing that users attention to the graphics 99 on the tab-like part 97.

The present invention has now been described with reference to several embodiments thereof. It will be apparent to those skilled in the art that many changes can be made in the embodiments described without departing from the scope of the present invention. For example, the backing layer for the advertising assembly may be formed of a printable polymeric material rather than paper. The first end portions of the sheets may not be more visually distinctive than their second end portions; and their second end portions, even when free of printing, may not be transparent when adhered to a substrate. Thus the scope of the present invention should not be limited to the structures described in this application, but only by structures described by the language of the claims and the equivalents of those structures.

We claim:

1. An advertising assembly, said assembly comprising:

a paper backing layer having opposite first and second major printable surfaces, said major surfaces being free of release coatings;

advertising indicia printed on at least one of said surfaces and printed in register with said one surface; and a plurality of sheets, each of said sheets comprising a layer of flexible polymeric material, having opposite major side surfaces, first and second opposite ends, opposite edge surfaces between said major side surfaces and said first and second opposite ends, and having a coating of repositionable pressure sensitive adhesive on one of said side surfaces along a second end portion adjacent said second end while being free of adhesive on both of said side surfaces along a first end portion thereof adjacent said first end, said first end portion being visually distinctive, and said adhesive coated second end portion, when free of printing, being generally transparent when adhered to a substrate;

said sheets being releasably adhered in parallel rows of the sheets to the first surface of the backing layer by said coatings of pressure sensitive adhesive with said sheets in each row of the sheets being positioned with the edge surfaces of adjacent sheets in the row of sheets adjacent to each other and with their first end portions aligned.

2. An advertising assembly according to claim 1 wherein said first end portions are smaller in area than said second end portions and are brightly colored, and said sheets are adhered in four parallel rows on said backing layer with the first end portions of the sheets in each of two pairs of said four rows being adjacent.

3. An advertising assembly according to claim 1 wherein the first and second end portions of said sheets are formed by only a single layer of polymeric material, said first end portions are printed with brightly colored ink to provide said visual distinction and said sheets are printed with indicia over said brightly colored ink on said first end portions and on said second end portions.

4. An advertising assembly according to claim 1 further including a plurality of said sheets releasably adhered to the surfaces of said sheets adhered to the backing layer that are opposite the backing layer.

5. An advertising assembly according to claim 1 wherein the major surfaces of said sheets have shapes corresponding to the outline of at least one known object or animal.

6. An advertising assembly according to claim 1 wherein said backing layer has aligned spaced fold line portions parallel to the rows of said sheets and aligned with the adjacent first ends of said sheets, and a cut through the backing layer between the adjacent ends of the fold line portions that extends under the first end portions of some of the sheets in one of the rows, said fold line portions and cut dividing the backing layer into first and second portions with said first portion including a major part and a tab-like part extending past the aligned fold line portions from said major part and under the first end portions of some of the sheets that are adhered to the second portion so that when the backing layer is bent along the aligned fold line portions to move toward each other the portions of its surface opposite the sheets, the tab-like part will deflect and move past the first end portions of the sheets over it, and move to a position where said tab-like part will project between the adjacent first ends of the sheets in the rows where the tab-like part and graphics printed on the tab-like part will be easily seen by a user of the advertising assembly.

7. An advertising assembly according to claim 1 wherein said backing layer is scored to form spaced fold lines extending parallel to the rows of sheets and positioned generally along the junctures between the first and second end portions of the sheets in the rows, said backing layer being bendable along those fold lines to separate the first end portions of the sheets in those rows from the backing layer and place them in a position at which they can be easily grasped to remove the sheets from the backing layer.

8. An advertising assembly, said assembly comprising:

a backing layer having opposite first and second major surfaces, at least one of said major surfaces being free of release coatings and being printable;

advertising indicia printed on at least said one of said surfaces and printed in register with said one surface; and a plurality of die cut sheets, each of said sheets comprising a layer of flexible polymeric material, having opposite major side surfaces, first and second opposite ends, and opposite edge surfaces between said major side surfaces and said first and second opposite ends, and having a coating of repositionable pressure sensitive adhesive on one of said side surfaces along a second end portion adjacent said second end while being free of adhesive on both of said side surfaces along a first end portion thereof adjacent said first end;

said sheets being releasably adhered in parallel rows of the sheets to the first surface of the backing layer by said coatings of pressure sensitive adhesive with said sheets in each row of the sheets being positioned with the edge surfaces of adjacent sheets in the row of sheets adjacent to each other and with their first end portions aligned; and at least some of said sheets are printed with indicia on at least one of said first and second end portions.

9. An advertising assembly according to claim 8 wherein said first end portions are smaller in area than said second end portions and are brightly colored, and said sheets are adhered in four parallel rows on said backing layer with the first end portions of the sheets in each of two pairs of said four rows being adjacent.

10. An advertising assembly according to claim 8 wherein the first and second end portions of said sheets are formed by only a single layer of polymeric material, said first end portions are printed with brightly colored ink to make them visually distinctive and said sheets are printed with indicia over said brightly colored ink on said first end portions and on said second end portions.

11. An advertising assembly according to claim 8 further including a plurality of said sheets releasably adhered to the surfaces of said sheets adhered to the backing layer that are opposite the backing layer.

12. An advertising assembly according to claim 8 wherein the major surfaces of said sheets have shapes corresponding to the outline of at least one known object or animal.

13. An advertising assembly according to claim 8 wherein said backing layer has aligned spaced fold line portions parallel to the rows of said sheets and aligned with the adjacent first ends of said sheets, and a cut through the backing layer between the adjacent ends of the fold line portions that extends under the first end portions of some of the sheets in one of the rows, said fold line portions and cut dividing the backing layer into first and second portions with said first portion including a major part and a tab-like part extending past the aligned fold line portions from said major part and under the first end portions of some of the sheets that are adhered to the second portion so that when the backing layer is bent along the aligned fold line portions to move toward each other the portions of its surface opposite the sheets, the tab-like part will deflect and move past the first end portions of the sheets over it, and move to a position where said tab-like part will project between the adjacent first ends of the sheets in the rows where the tab-like part and graphics printed on the tab-like part will be easily seen by a user of the advertising assembly.

14. An advertising assembly according to claim 8 wherein said backing layer is scored to form spaced fold lines extending parallel to the rows of sheets and positioned generally along the junctures between the first and second end portions of the sheets in the rows, said backing layer being bendable along those fold lines to separate the first end portions of the sheets in those rows from the backing layer and place them in a position at which they can be easily grasped to remove the sheets from the backing layer.

* * * * *